US006247433B1

(12) United States Patent
Faria et al.

(10) Patent No.: US 6,247,433 B1
(45) Date of Patent: Jun. 19, 2001

(54) SWITCHABLE CAM FOLLOWER

(75) Inventors: Christof Faria, Erlangen; Oliver Schnell, Weisendorf, both of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/539,532

(22) Filed: Mar. 31, 2000

(30) Foreign Application Priority Data

Apr. 7, 1999 (DE) ..... 199 15 531

(51) Int. Cl.[7] ..... F01L 1/12
(52) U.S. Cl. ..... 123/90.16; 123/90.5; 123/90.55
(58) Field of Search ..... 123/90.16, 90.48, 123/90.49, 90.5, 90.55

(56) References Cited

U.S. PATENT DOCUMENTS

| | | | | |
|---|---|---|---|---|
| 5,351,662 | * | 10/1994 | Dopson et al. | 123/90.16 |
| 5,454,353 | * | 10/1995 | Elendt et al. | 123/90.16 |
| 5,720,244 | * | 2/1998 | Faria | 123/90.16 |
| 5,782,216 | * | 7/1998 | Haas et al. | 123/90.16 |
| 5,832,884 | * | 11/1998 | Haas et al. | 123/90.16 |

FOREIGN PATENT DOCUMENTS

| | | |
|---|---|---|
| 4440133 | 5/1996 | (DE) . |
| 19500575 | 7/1996 | (DE) . |
| 19608651 | 9/1997 | (DE) . |
| 19801701 | 7/1999 | (DE) . |
| 0608925 | 8/1994 | (EP) . |
| 0685634 | 12/1995 | (EP) . |

* cited by examiner

*Primary Examiner*—Weilun Lo
(74) *Attorney, Agent, or Firm*—Bierman, Muserlian and Lucas

(57) ABSTRACT

A switchable cam follower (1) of a valve train of an internal combustion engine, a stop means (19) extending between the axially relatively displaceable components, housing (2) and inner element (6), of the cam follower (1), a first component of the stop means (19) being a locking element (15) fixed in a reception (12) of the inner element (6), the locking element (15) extends radially outwardly into a slot (18) which is a further component of the stop means (19) and slot (18) has an upper end (20) which defines an upper end stop whereby the locking element (15) extends over a substantial part of half a length of the reception (12) in the inner element (6) and, at the same time, penetrates to the largest possible extent through the housing (2) in the region of the slot (18) which guarantees an excellent fixing of the locking element (15) in the housing (2) which is maintained through the entire life of the cam follower (1), and is further assured that component loading resulting from abutment is only slight.

7 Claims, 1 Drawing Sheet

SWITCHABLE CAM FOLLOWER

FIELD OF THE INVENTION

The invention concerns a switchable cam follower of a valve train of an internal combustion engine, wherein the cam follower comprises a housing adapted to be mounted with an outer wall in a bore of the internal combustion engine or in a bore of a component connected to the internal combustion engine, the housing comprises a recess which encloses an inner element that is axially displaceable relative to the housing, each of said housing and said inner element comprising a reception extending in radial or secant direction, said receptions being aligned to each other in a defined relative position, at least one coupling means is arranged in at least one of the receptions and said coupling means can be displaced toward the other of the receptions for coupling the inner element to the housing in said relative position, a stop means extends between the housing and the inner element and prevents a rotation of the inner element relative to the housing while also forming an upper end stop for defining the relative position.

BACKGROUND OF THE INVENTION

A support element having a structure similar to the pre-cited cam follower is known from DE-A 197 10 578. The stop means of this support element comprises a narrow cylindrical element which extends in a recess of the housing and projects slightly in radially inward direction. In its inner region, this cylindrical element cooperates on the one hand with a longitudinal groove on the outer wall of the inner element and, on the other hand, with a bore-proximate shoulder of this longitudinal groove which acts as an upper end stop to define the relative position of the inner element and the housing.

A drawback of this prior art support element is that only an extremely short length of its stop means is fixed in the reception of the housing. At the same time, its extension toward the inner element by which the upper end stop and the prevention of rotation are realized has only a minimal dimension. This results in the formation of enormous stresses in the regions of fixation and of the upper end stop of the stop means when this is subjected to rotational and impact loads. Another danger is that the stop means may come loose from its locked position so that, in the worst case, an alignment of the receptions for the coupling means in the inner element and the housing for realizing the relative position is rendered more difficult or even impossible and, due to material loading, the surrounding material in the region of the stop means is deformed.

OBJECTS OF THE INVENTION

It is an object of the invention to create an improved switchable cam follower of the pre-cited type in which the aforesaid drawbacks are eliminated.

This and other objects and advantages of the invention will become obvious from the following detailed description.

SUMMARY OF THE INVENTION

The invention achieves the above objects by the fact that a locking element such as a piston is arranged as a first component of the stop means in the reception of the inner element, an inner jacket section of the locking element extends over at least a substantial part of half a length of the reception, an outer jacket section of the locking element forming a second component of the locking element engages into a slot of the housing, the slot fixes the locking element in peripheral direction of the housing and has an axial dimension corresponding to at least a length of a desired relative displacement, one end of the slot forming the upper end stop, and the outer jacket section of the locking element extends at least through a largest possible dimension of the slot toward an outer peripheral surface of the housing.

Thus, by simple means, a switchable cam follower is created whose stop means is reliably fixed and in which the loading of components in the region of the stop means is greatly reduced. The use of the inventive measures in a cam follower not only drastically prolongs the useful life thereof but it also improves the reliability and quality of operation. This is particularly due to the fact that the fixing and stop length for the stop means is greatly increased over the prior art. The stress occurring in the region of the slot when the stop means abuts against the upper end stop in the region of one end of the slot is greatly reduced. A cam follower incorporating the measures of the invention is simpler as well as cheaper to manufacture than prior art devices. An additional advantage is that the slot leads to a noticeable reduction of the total mass of the cam follower and this has a positive influence on the oscillating masses of a valve train having a switchable cam follower in which the inventive measures are incorporated.

It is understood that the features of the invention can likewise be implemented in a support element of a lever-type cam follower so that the aforesaid advantages can also be attained with such a support element.

According to a further feature of the invention, the coupling means is configured as a piston and arranged in the reception of the inner element diametrically opposite the locking element. This measure leads to a reduction of the number of components required compared to the cited prior art because the locking element serves at the same time as a support for one end of the spring in the reception of the inner element. A person skilled in the art will also recognize that the snap ring of the mentioned prior art can be omitted because, according to a further proposition of the invention, the reception for the coupling means in the housing has a stepped configuration and forms a stop for the coupling means. However, other stop measures such as separate stop elements or lugs and the like projecting into the bore are also conceivable.

According to an advantageous feature of the invention, a displacement of the coupling means in its uncoupling direction is achieved by a hydraulic medium which can be conducted in a simple manner to an outer end face of the coupling means through the reception of the housing. For this purpose, in the installed state, the reception of the housing communicates with an appropriate passage in the internal combustion engine. The coupling means may also be displaced in both directions of displacement by the hydraulic medium, or the described kinematic principle may be reversed.

Advantageously, a hydraulic clearance compensation element is installed in the inner element. This adjusts in a manner, known, per-se, during a base circle phase of the actuating cam, the entire play occurring in the valve train to zero.

According to a further feature of the invention, the cam follower is configured as a roller tappet which cooperates directly with a bottom camshaft and acts at its camshaft-distal end on a push rod. However, the invention is also applicable to a cam follower configured as a switchable cup tappet as well as to cam followers or support elements in which the coupling means is arranged in the housing and displaced toward the inner element to establish the coupled state.

According to a final proposition of the invention, an anti-rotation device configured as an extension or a pin is fixed in the outer wall of the housing and extends beyond this outer wall. The housing, and thus also the cam follower, is positionally fixed by this anti-rotation device relative to the bore of the internal combustion engine. The anti-rotation device may be a simple cylindrical body or a ball, but may also be made integrally with the housing, for example, as a tab.

The invention will now be described more closely with reference to the attached drawings.

DETAILED DESCRIPTION OF THE DRAWINGS

Figure 1:
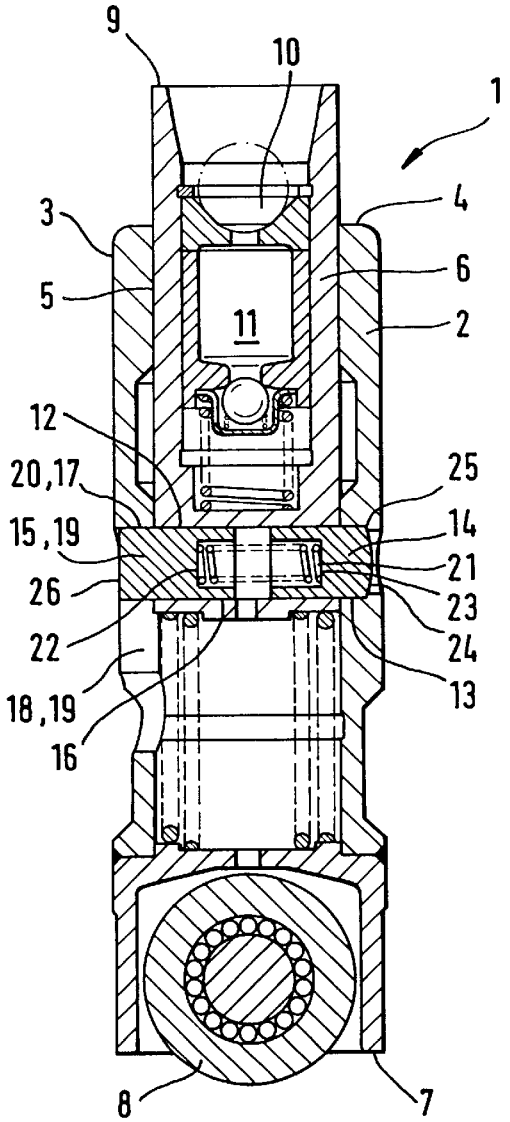
FIG. 1 is a longitudinal cross-section through a switchable cam follower configured as a roller tappet, showing the locking element and the coupling means.

FIG. 1 discloses a switchable cam follower configured as a roller tappet and comprising a housing 2 which can be inserted into a bore of an internal combustion engine, not shown, with its outer wall 3. In the region of a second end face 4, the housing 2 comprises a recess 5 into which an inner element 6 is inserted. The inner element 6 is arranged for axial displacement relative to the housing 2 in a known manner.

In the region of a first end 7, the housing 2 comprises a roller 8 for direct contact with a cam, not illustrated. On its end 9 distal from the first end 7, the inner element 6 comprises a support surface 10 for an end of a push rod, not shown. This support surface 10 forms a part of a clearance compensation element 11 which does not need to be described in the present context.

Each of the inner element 6 and the housing 2 comprises a reception 12, 13 made as a bore. The two receptions 12, 13 are aligned to each other in the relative position of the housing 2 and the inner element 6 disclosed in FIGS. 1 and 2. A coupling means 14 configured as a piston extends in the reception 12 of the inner element 6 (in the FIGS., on the right of the longitudinal axis). A locking element 15 such as a piston is pressed into the reception 12 in a position diametrically opposite to the coupling means 14. This locking element 15 extends with its inner jacket section 16 over a substantial part of half the length of the reception 12.

An outer jacket section 17 of the locking element 15 projects radially beyond the inner element 6 into a slot 18 which is situated opposite thereto, and, together with the locking element 15, constitutes a stop means 19. The slot 18 fixes the locking element 15 in peripheral direction and has an axial dimension corresponding at least to a length of a desired displacement of the inner element 6 relative to the housing 2. An upper end 20 of the slot 18 serves as an upper end stop for defining the relative position. In the relative position (coupled state) shown in FIGS. 1 and 2, the full lift of the actuating cam is transmitted to the gas exchange valve indirectly through the push rod.

A compression spring 21 likewise extends in the reception 12 of the inner element 6. This spring 21 is supported at one end on an inner end face 22 of the locking element 15 and, at the other end, on an inner end face 23 of the coupling means 14 and it therefore urges the coupling means 14 in a radially outward direction of displacement.

Hydraulic medium can be routed to a radially outer end face 24 of the coupling means 14 through the reception 13 in the housing 2 to effect a complete re-displacement of the coupling means 14 into its reception 12 in the inner element 6.

The inventive structure of the stop means 19, i.e. the slot 18 with its end 20 and the piston-like locking element 15, creates not only a simple and economically realizable upper end stop for defining the relative position of the inner element 6 and the housing 2 but it is also an efficient anti-rotation device for the two said components 6 and 2. As already discussed in the introduction of the description, component loading in the region of the locking element 15 and its surrounding material is low. During the operation of the cam follower 1, a change of position of the locking element 15 due to an inadequate press-in length of the locking element 15 in the inner element 6 can no longer occur.

The cam follower 1 of the invention at the same time requires a lesser number of components compared to the prior art. The stepped configuration of the reception 13 in the housing 2 creates a stop 25 for the coupling means 14 in radially outward direction. Thus, the snap ring otherwise required in the prior art for fixing the coupling means 14 radially outwardly can be omitted. Similarly, a separate component for forming a support for the compression spring 21 in the region of the locking element 15 is no longer required because the inner end face 22 of the locking element 15 simultaneously serves as a support for one end of the compression spring 21.

Advantageously, the locking element 15 extends with its outer end face 26 up to a point immediately in front of the outer peripheral surface of the housing 2. This assures a wide contact of the locking element 15 on the end 20 of the slot 18 when abutment takes place. Due to this long contact length, component loading upon abutment is only slight.

Figure 2:
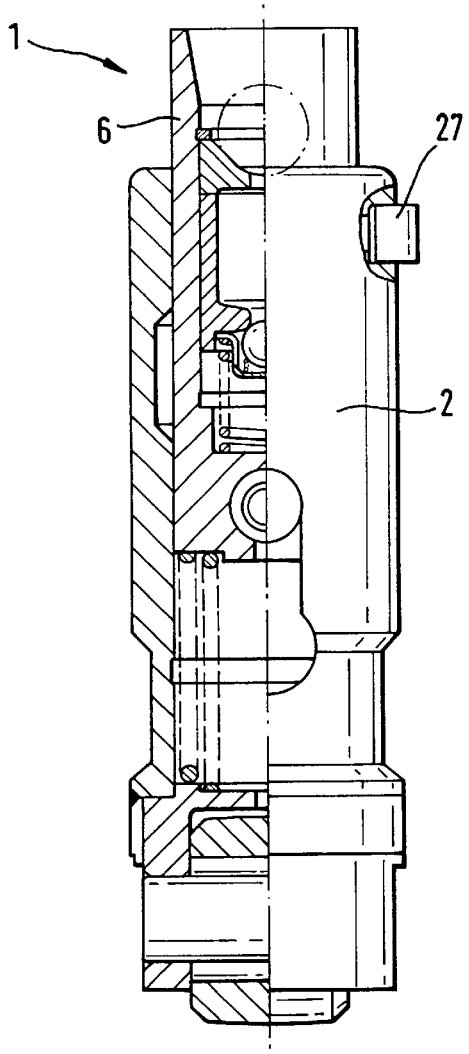
FIG. 2 shows a partial longitudinal cross-section of the cam follower of FIG. 1, turned through 90°.

FIG. 2 additionally shows that an anti-rotation device 27 is arranged in the outer wall 3 of the housing 3. This anti-rotation device 27 fixes the entire cam follower 1 relative to the bore of the internal combustion engine in the peripheral direction.

Figure 3:
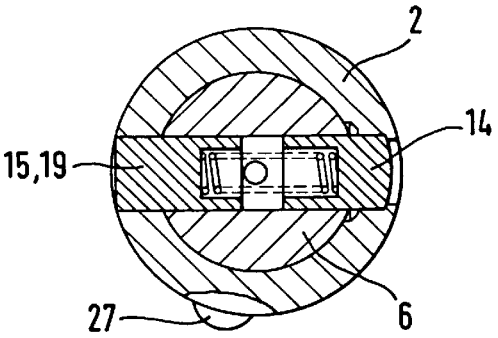
FIG. 3 shows a transverse cross-section through the cam follower in the region of its receptions.

FIG. 3 shows a transverse cross-section through the cam follower 1 in the region of the receptions 12, 13 which is self-explanatory.

What is claimed is:

1. A switchable cam follower of a valve train of an internal combustion engine, wherein the cam follower comprises a housing adapted to be mounted with an outer wall in a bore of the internal combustion engine or in a bore of a component connected to the internal combustion engine, the housing comprises a recess which encloses an inner element that is axially displaceable relative to the housing, each of said housing and said inner element comprising a reception extending in radial direction, said receptions being aligned to each other in a defined relative position, at least one coupling means is arranged in at least one of the receptions and said coupling means can be displaced toward the other of the receptions for coupling the inner element to the housing in said relative position, a stop means extends between the housing and the inner element and prevents a rotation of the inner element relative to the housing while also forming an upper end stop for defining the relative position, a locking element is arranged as a first component of the stop means in the reception of the inner element, an inner jacket section of the locking element extending over at least a substantial part of half a length of the reception of the inner element, an outer jacket section of the locking element forming a second component of the locking element and engaging into a slot of the housing, the slot fixes the locking element in peripheral direction of the housing and has an axial dimension corresponding to at least a length of a desired relative displacement, one end of the slot forming the upper end stop, and the outer jacket section of the locking element extending at least through a largest possible dimension of the slot toward an outer peripheral surface of the housing.

2. A cam follower of claim 1 wherein the coupling means is configured as a piston and arranged in the reception of the inner element diametrically opposite the locking element.

3. A cam follower of claim 2 wherein at least one compression spring extends in the reception of the inner element while being supported at one end on an inner end face of the locking element and, at another end, on an inner end face of the coupling element, in said relative position of the inner element and the housing, the reception of the housing is situated diametrically opposite an outer end face of the coupling means, the reception of the housing forms a through-aperture in the outer wall of the housing, and hydraulic medium can be conducted through the reception of the housing to the outer end face of the coupling means to displace the coupling means completely into the reception of the inner element.

4. A cam follower of claim 1 wherein the reception of the housing comprises a diameter reduction as a stop for the coupling means in a direction of outward displacement of the coupling means.

5. A cam follower of claim 1 wherein a hydraulic clearance compensation element is installed in the inner element.

6. A cam follower of claim 1 configured as a roller tappet whose housing comprises on a first end, a roller for a direct contact with a cam and, on a second end distal from the first end, the housing comprises the recess for the inner element, which inner element comprises on an end oriented similarly to the second end of the housing, a support surface for a push rod.

7. A cam follower of claim 1 wherein an anti-rotation device configured as an extension or a pin is fixed in the outer wall of the housing and extends radially beyond the outer wall.

* * * * *